US005898119A

United States Patent [19]

Tseng et al.

[11] Patent Number: 5,898,119

[45] Date of Patent: Apr. 27, 1999

[54] METHOD AND APPARATUS FOR GENERATING MUSICAL ACCOMPANIMENT SIGNALS, AND METHOD AND DEVICE FOR GENERATING A VIDEO OUTPUT IN A MUSICAL ACCOMPANIMENT APPARATUS

[75] Inventors: Kevin Tseng; Kuang-Hsun Hsieh; William Wang, all of Taipei, Taiwan

[73] Assignee: Mitac, Inc., Taipei, Taiwan

[21] Appl. No.: 08/867,485

[22] Filed: Jun. 2, 1997

[51] Int. Cl.[6] ..... G10H 1/36; G10H 7/00

[52] U.S. Cl. ..... 84/610; 434/307 A

[58] Field of Search ..... 84/610, 634; 434/307 A

[56] References Cited

U.S. PATENT DOCUMENTS

| | | | |
|---|---|---|---|
| 5,561,649 | 10/1996 | Lee et al. . | |
| 5,631,433 | 5/1997 | Iida et al. | 84/634 X |
| 5,683,253 | 11/1997 | Park et al. | 434/307 A |
| 5,726,373 | 3/1998 | Choi et al. | 84/609 |

*Primary Examiner*—William M. Shoop, Jr.
*Assistant Examiner*—Jeffrey W. Donels
*Attorney, Agent, or Firm*—Alston & Bird LLP

[57] ABSTRACT

In a method and apparatus for generating audio-visual musical accompaniment signals corresponding to a musical program, there is provided a recording medium which has an audio storage unit, a lyric storage unit and a video storage unit separate from the audio storage unit and the lyric storage unit. The audio storage unit and the lyric storage unit respectively have a plurality of audio music data and a plurality of lyric data corresponding to a plurality of the musical programs stored therein. The video storage unit has a plurality of video segments to be commonly shared by the plurality of the musical programs stored therein. In operation, the audio music data and the lyric data corresponding to a selected one of the musical programs are retrieved from the recording medium, while at least a section of the video segments are retrieved from the recording medium in an order. The audio music data retrieved from the recording medium is converted into an audio output, and the lyric data and the sections of the video segments retrieved from the recording medium are combined to obtain a video output. The audio and video outputs constitute the musical accompaniment signals corresponding to the selected one of the musical programs.

23 Claims, 4 Drawing Sheets

METHOD AND APPARATUS FOR GENERATING MUSICAL ACCOMPANIMENT SIGNALS, AND METHOD AND DEVICE FOR GENERATING A VIDEO OUTPUT IN A MUSICAL ACCOMPANIMENT APPARATUS

BACKGROUND OF THE INVENTION

1. Field of the Invention

The invention relates to a method and apparatus for generating audio-visual musical accompaniment signals corresponding to a musical program, more particularly to a method and device for generating a video output in a musical accompaniment apparatus which generates musical accompaniment signals corresponding to a musical program.

2. Description of the Related Art

An apparatus capable of reproducing audio-visual signals which were recorded on a recording medium is known in the art. One example of such an apparatus is a karaoke reproducing apparatus which reproduces audio-visual musical accompaniment signals that were especially prepared for people to sing along with.

In the conventional karaoke reproducing apparatus, the musical accompaniment signals of a musical program include audio music data, video data and lyric data overlaid onto the video data. Currently, the musical accompaniment signals corresponding to one musical program are stored in a single file encoded in the Moving Picture Expert Group (MPEG) standard format. Thus, each musical program takes up a relatively large amount of storage space, thereby resulting in a relatively small number of musical programs that can be recorded on a single recording medium.

SUMMARY OF THE INVENTION

The main object of the present invention is to provide a method and apparatus for generating audio-visual musical accompaniment signals which permits a musical program to take up a smaller amount of storage space to result in a larger number of musical programs that can be recorded on a single recording medium as compared to the prior art.

Specifically, the object of the present invention is to provide a method and apparatus for generating audio-visual musical accompaniment signals in which the video data are stored separately from the audio music data and the lyric data and are to be commonly shared by a plurality of musical programs so as to permit the recording of a larger number of the musical programs on a single recording medium as compared to the prior art.

According to one aspect of the invention, a method for generating audio-visual musical accompaniment signals corresponding to a musical program comprises the steps of:

(a) providing a recording medium which has an audio storage unit, a lyric storage unit and a video storage unit separate from the audio storage unit and the lyric storage unit, the audio storage unit and the lyric storage unit respectively having a plurality of audio music data and a plurality of lyric data corresponding to a plurality of the musical programs stored therein, the video storage unit having a plurality of video segments to be commonly shared by the plurality of the musical programs stored therein;

(b) retrieving the audio music data and the lyric data corresponding to a selected one of the musical programs from the recording medium;

(c) retrieving at least a section of the video segments from the recording medium in an order;

(d) converting the audio music data retrieved from the recording medium into an audio output; and (e) combining the lyric data and the sections of the video segments retrieved from the recording medium to obtain a video output;

the audio and video outputs constituting the musical accompaniment signals corresponding to the selected one of the musical programs.

According to another aspect of the invention, an apparatus for generating audio-visual musical accompaniment signals corresponding to a musical program comprises:

a recording medium which has an audio storage unit, a lyric storage unit and a video storage unit separate from the audio storage unit and the lyric storage unit, the audio storage unit and the lyric storage unit respectively having a plurality of audio music data and a plurality of lyric data corresponding to a plurality of the musical programs stored therein, the video storage unit having a plurality of video segments to be commonly shared by the plurality of the musical programs stored therein;

processor means connected to the recording medium and operable so as to retrieve the audio music data and the lyric data corresponding to a selected one of the musical programs from the recording medium, and so as to retrieve at least a section of the video segments from the recording medium in an order;

audio converting means connected to the processor means for converting the audio music data from the recording medium into an audio output; and combining means connected to the processor means for combining the lyric data and the sections of the video segments retrieved from the recording medium to obtain a video output;

the audio and video outputs constituting the musical accompaniment signals corresponding to the selected one of the musical programs.

According to still another aspect of the invention, a method for generating a video output is to be applied in a musical accompaniment apparatus which generates musical accompaniment signals corresponding to a musical program, and which includes a recording medium with an audio storage unit and a lyric storage unit that respectively have a plurality of audio music data and a plurality of lyric data corresponding to a plurality of the musical programs stored therein. The audio music data and the lyric data corresponding to a selected one of the musical programs are retrievable from the recording medium. The method comprises the steps of:

(a) providing a video storage unit separate from the audio storage unit and the lyric storage unit, the video storage unit having a plurality of video segments to be commonly shared by the plurality of the musical programs stored therein;

(b) retrieving at least a section of the video segments from the video storage unit in an order; and (c) combining the lyric data corresponding to the selected one of the musical programs and the sections of the video segments retrieved from the video storage unit to obtain the video output.

According to a further aspect of the invention, a device for generating a video output is to be installed in a musical accompaniment apparatus which generates musical accompaniment signals corresponding to a musical program, and which includes a recording medium with an audio storage unit and a lyric storage unit that respectively have a plurality of audio music data and a plurality of lyric data corresponding to a plurality of the musical programs stored therein. The audio music data and the lyric data corresponding to a selected one of the musical programs are retrievable from the recording medium. The device comprises:

a video storage unit separate from the audio storage unit and the lyric storage unit, the video storage unit having a plurality of video segments to be commonly shared by the plurality of the musical programs stored therein;

processor means connected to the video storage unit and operable so as to retrieve at least a section of the video segments from the video storage unit in an order; and combining means connected to the processor means and adapted to combine the lyric data corresponding to the selected one of the musical programs and the sections of the video segments retrieved from the video storage unit to obtain the video output.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
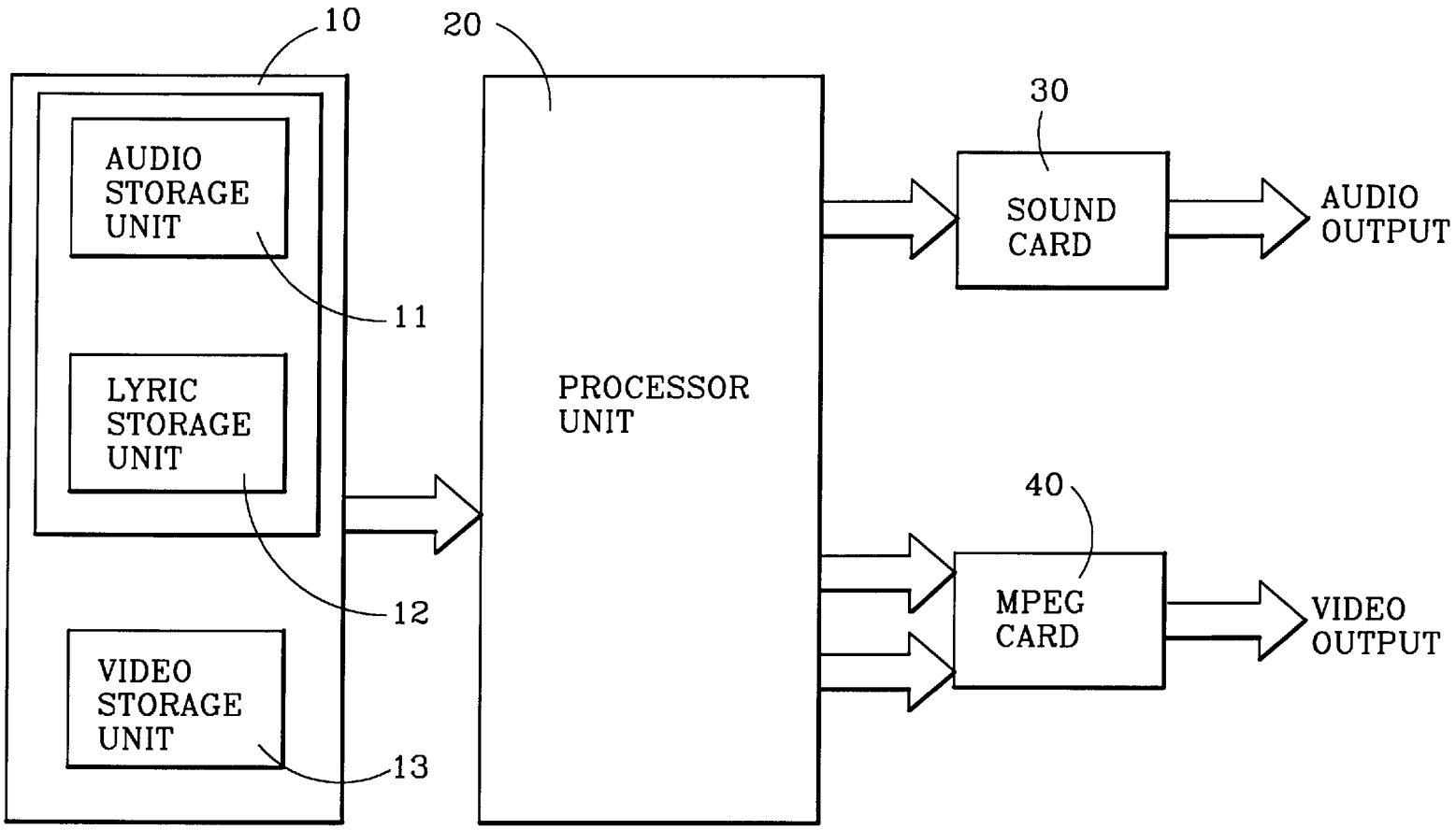
FIG. 1 is a schematic circuit block diagram of the first preferred embodiment of a musical accompaniment apparatus according to the present invention.

Before the present invention is described in greater detail, it should be noted that like elements are denoted by the same reference numerals throughout the disclosure.

Referring to FIG. 1, the first preferred embodiment of a musical accompaniment apparatus according to the present invention is shown to comprise a recording medium 10, a processor unit 20, a sound card 30 and an MPEG card 40.

The recording medium 10, which may be in the form of a hard disk or a CD-ROM, includes an audio storage unit 11, a lyric storage unit 12 and a video storage unit 13. The audio storage unit 11 and the video storage unit 12 respectively have a plurality of audio music data and a plurality of lyric data, which correspond to a plurality of musical programs, stored therein. In this embodiment, the audio storage unit 11 and the video storage unit 12 are combined into one unit such that the audio music data and the lyric data corresponding to a musical program are stored in a single corresponding file encoded in the MPEG standard format, as is known in the art. However, unlike the prior art, the video storage unit 13 is separate from the audio storage unit 11 and the lyric storage unit 12, and has a plurality of video segments, which are to be commonly shared by all of the musical programs, stored therein. The video segments are prepared with the use of an image capturing device, such as a camera, and may pertain to people, animals, plants or scenic spots. The video segments are stored in the video storage unit 13 in the MPEG standard coding format.

The processor unit 20 is connected to the recording medium 10, the sound card 30 and the MPEG card 40. The processor unit 20 cooperates with the audio storage unit 11, the lyric storage unit 12 and the sound card 30 to form an audio output generating device, and further cooperates with the video storage unit 13 and the MPEG card 40 to form a video output generating device. The processor unit 20 is operable so as to output a selected one of the musical programs. Selection of a musical program is done in a known manner, such as with the use of a remote control device (not shown). Upon selection, the processor unit 20 is programmed to retrieve the audio music data and the lyric data corresponding to the selected musical program from the recording medium 10. At the same time, the processor unit 20 is programmed to retrieve the video segments from the recording medium 10 in a random or sequential manner. The processor unit 20 provides the audio music data retrieved thereby to the sound card 30. The sound card 30 is connected to an audio output device (not shown), such as a loudspeaker, and serves to convert the audio music data into an analog audio output to be received by the audio output device. The processor 20 provides the lyric data and the video segments retrieved thereby to the MPEG card 40. The MPEG card 40 is connected to a video output device (not shown), such as a monitor, and serves to combine the lyric data and the video segments retrieved from the recording medium 10 to obtain an NTSC television video output signal to be received by the video output device.

In one preferred implementation, the video segments and the audio music data are classified into different categories according to the mood which they convey to the viewer, e.g. happy, sad, romantic, etc. The video segments in one of the categories can then be retrieved in a random or sequential manner to match the mood of the selected musical program.

It should be noted that, when the video segments are retrieved from the recording medium 10 in a random manner, the video segments which are retrieved when a musical program is selected for the second time may differ from those retrieved when the same musical program is selected for the first time, thereby creating a livelier environment as compared to the prior art which relies on a fixed set of images for a particular musical program.

Preferably, the durations of the video segments retrieved from the recording medium 10 are shorter than those of the audio music data, and each video segment may be retrieved from the recording medium 10 in its entirety. As such, the video segments may be processed prior to storage in the recording medium 10 so as to generate a fade-in effect at the start of the video segment and a fade-out effect at the end of the video segment, thereby avoiding sharp transitions between successive video segments.

Alternatively, only sections of the video segments may be retrieved from the recording medium 10 so as to further increase the variety of the images shown by the video output device for a selected musical program. Under this situation, the processing unit 20 is programmed to process the section of a preceding one of the video segments retrieved from the recording medium 10 to generate a fade-out effect at the end of the section of the preceding one of the video segments, and further processes the section of a succeeding one of the video segments retrieved from the recording medium 10 to generate a fade-in effect at the start of the section of the succeeding one of the video segments.

The apparatus of this invention further allows for skipping from a current video segment being retrieved by the processor unit 20 to another video segment as desired by the user. Control of the processor unit 20 to achieve this function can be done with the use of the remote control device (not shown).

Therefore, in the apparatus of this invention, the total number of video segments stored in the recording medium 10 may be fewer than the total number of musical programs so as to result in a 5 to 10% reduction in the cost per musical program, and so as to permit a corresponding increase in the number of the musical programs that can be recorded on a single recording medium as compared to the prior art.

Figure 2:
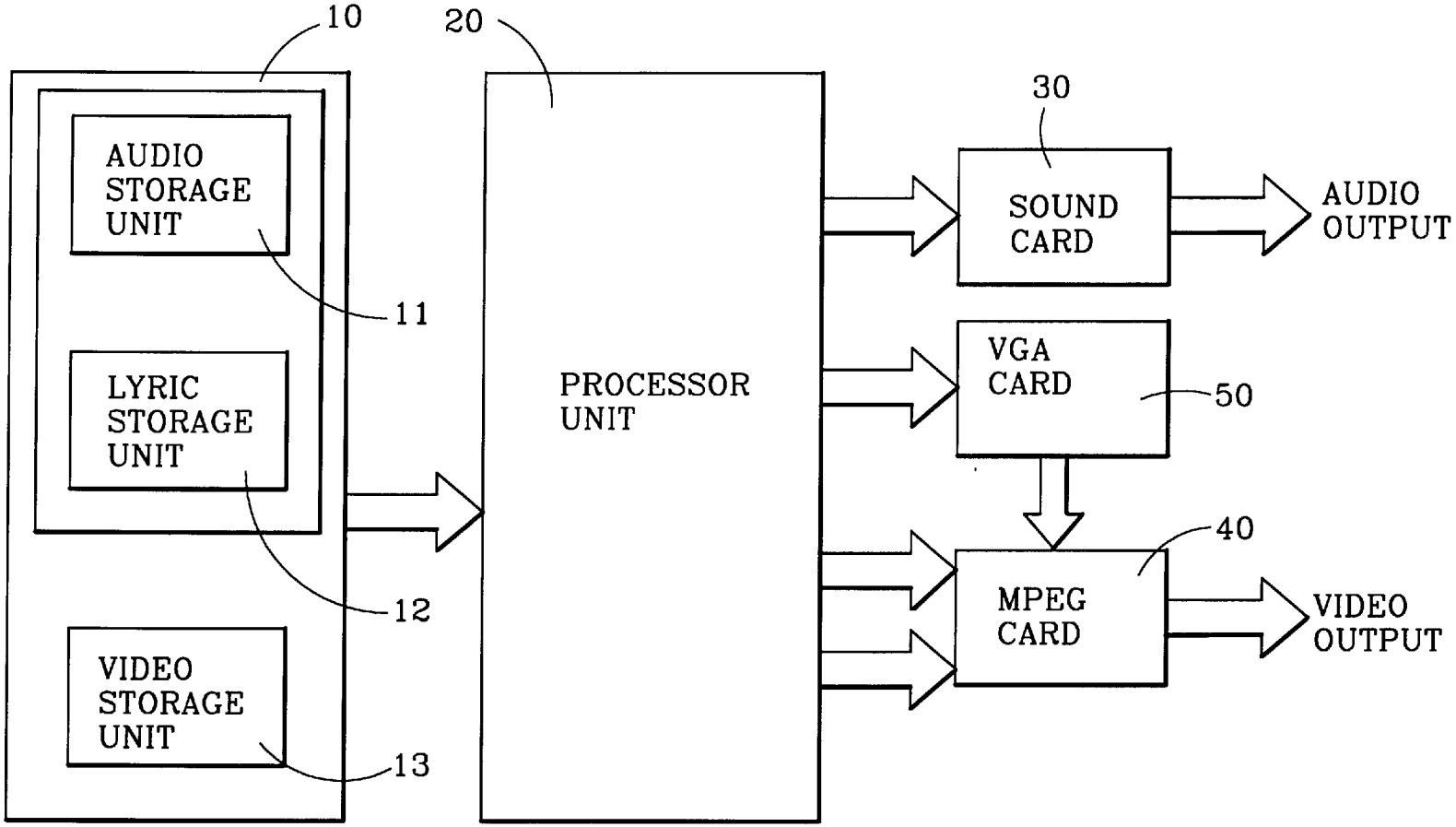
FIG. 2 is a schematic circuit block diagram of the second preferred embodiment of a musical accompaniment apparatus according to the present invention.

FIG. 2 is a schematic circuit block diagram of the second preferred embodiment of this invention. Unlike the previous embodiment, the lyric storage unit 12 is separate from the audio storage unit 11. In addition, the apparatus of this embodiment further comprises a Video Graphics Adapter (VGA) card 50 connected to the processor unit 20 and the MPEG card 40.

Figure 3:
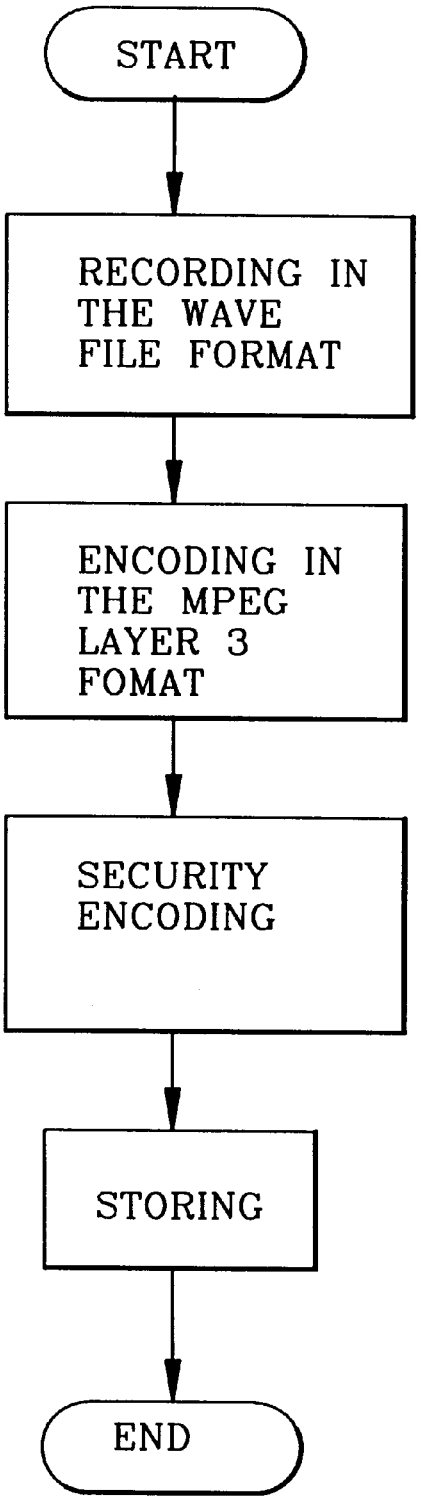
FIG. 3 is a flowchart illustrating how audio music data is prepared in the second preferred embodiment.

Referring to FIG. 3, the audio music data stored in the audio storage unit 11 is prepared in the following manner: Initially, the audio music data for a musical program is recorded in a WAVE file format. Thereafter, the WAVE file is encoded in the MPEG Layer 3 standard format, and the MPEG Layer 3 file is further encoded to guard against unauthorized duplication prior to storage in the audio storage unit 11. As such, with the audio music data stored in the MPEG Layer 3 standard format, an audio output of higher quality can be obtained as compared with the prior art which uses the audio music data encoded in the MIDI format.

Figure 4:
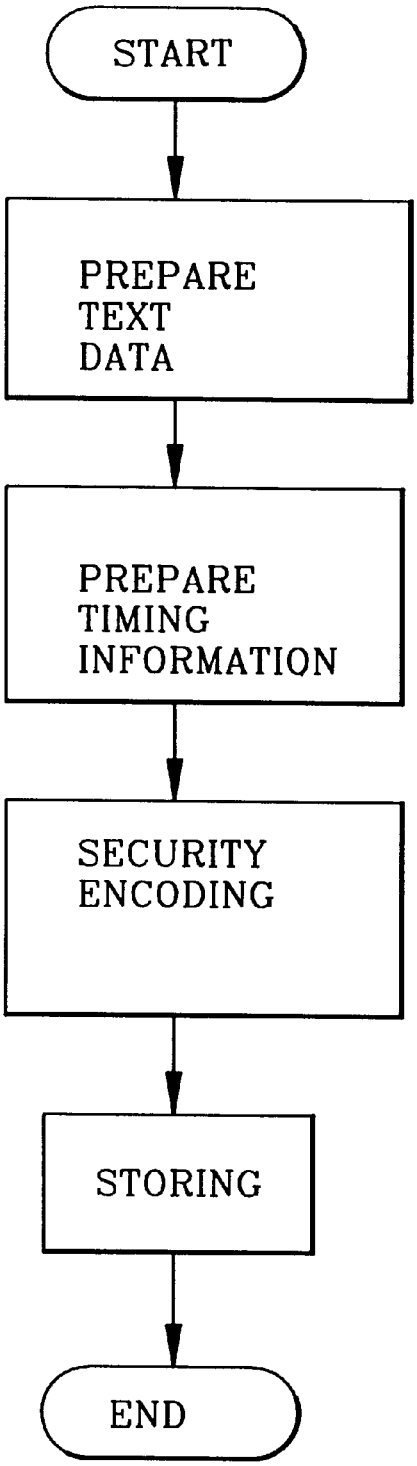
FIG. 4 is a flowchart illustrating how lyric data is prepared in the second preferred embodiment.

The lyric data stored in the lyric storage unit 12 includes encoded text data and timing information for synchronizing the text data with the audio music data as they are retrieved from the recording medium 10 when outputting a selected musical program. Referring to FIG. 4, the lyric data stored in the lyric storage unit 12 is prepared in the following manner: Initially, the text data is obtained in a conventional manner with the use of a character input device (not shown) and is stored as a script file. The timing information is then obtained while the audio music data is in the WAVE file format. The text data and the timing information are then encoded to guard against unauthorized duplication prior to storage in the lyric storage unit 12.

Like the previous embodiment, the different video segments stored in the video storage unit 13 are prepared with the use of an image capturing device, such as a camera, and are encoded using the MPEG standard coding format. In this embodiment, the video segments are classified into different categories according to the mood which they convey to the viewer, e.g. happy, sad, romantic, etc., in order to match the mood of the selected musical program.

Figure 5:
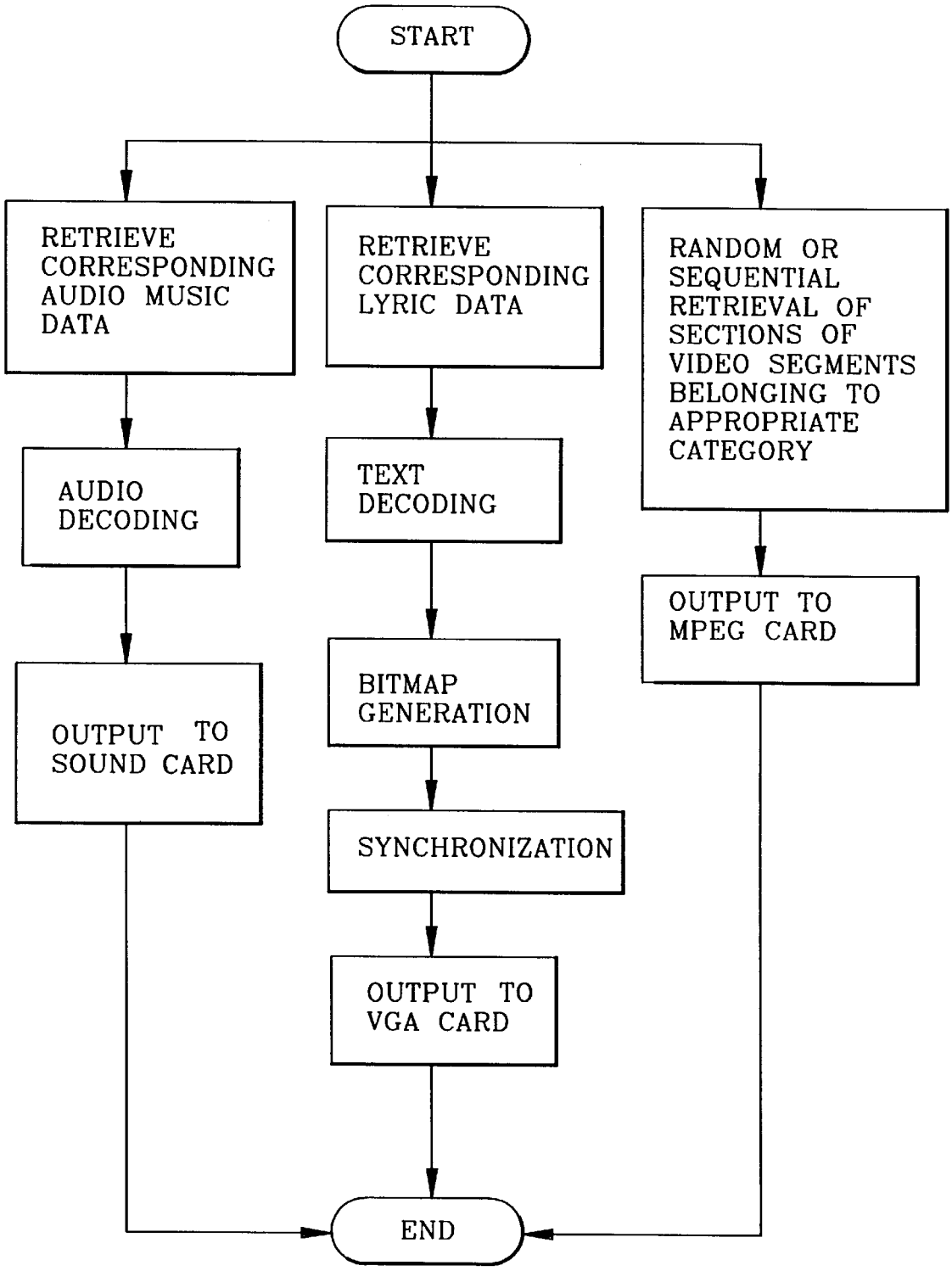
FIG. 5 is a flowchart illustrating the operation of a processor unit in the second preferred embodiment.

FIG. 5 is a flowchart illustrating the operation of the processor unit 20 in the second preferred embodiment. As illustrated, upon actuation of a control device (not shown) so as to select a musical program, the processor unit 20 retrieves the audio music data and the lyric data corresponding to the selected musical program from the recording medium 10. The processor unit 20 decodes the audio music data before providing the same to the sound card 30, which in turn is connected to an audio output device (not shown) for audio reproduction purposes, as shown in FIG. 2. The processor unit 20 decodes the lyric data to recover the text data and the timing information. The processor unit 20 then generates bitmap data corresponding to the text data, and synchronizes the supply of the bitmap data to the VGA card 50 with the supply of the audio music data to the sound card 30 in accordance with the timing information. The VGA card 50 serves to convert the bitmap data received thereby into a VGA signal that is supplied to the MPEG card 40, as shown in FIG. 2.

Simultaneous with the retrieval of the audio music data and the lyric data from the recording medium 10, the processor unit 20 retrieves at least a section of a video segment belonging to the appropriate category that matches the mood of the selected musical program from the recording medium 10 in a random or sequential manner. Since the retrieved sections of the video segments are shorter than those of the audio music data, a number of sections of the video segments are required for each musical program. To avoid sharp transitions between successive video segments, the processing unit 20 can be programmed to process the section of a preceding one of the video segments retrieved from the recording medium 10 to generate a fade-out effect at the end of the section of the preceding one of the video segments, and further process the section of a succeeding one of the video segments retrieved from the recording medium 10 to generate a fade-in effect at the start of the section of the succeeding one of the video segments. Of course, if the video segments are retrieved from the recording medium 10 in their entirety, the video segments can be processed instead prior to storage in the recording medium 10 so as to generate a fade-in effect at the start of the video segment and a fade-out effect at the end of the video segment. The processor unit 20 provides the video segments retrieved thereby to the MPEG card 40.

Referring again to FIG. 2, the MPEG card 40 combines the VGA signal from the VGA card 50 with the video segments from the processor unit 20 by overlaying the text data corresponding to the selected musical program onto the video segments. The MPEG card 40 supplies an NTSC television video output signal to a video output device (not shown).

Preferably, the timing information includes highlighting information which enables the processor unit 20 to perform highlighting of the text data as they are shown on the video output device using known methods, including underlining, displaying in bold, color inversion or a bouncing ball indication.

As with the previous embodiment, the apparatus of FIG. 2 further allows for skipping from a current video segment to another video segment as desired by the user. Control of the processor unit 20 to achieve this function can be done with the use of the control device (not shown).

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A method for generating audio-visual musical accompaniment signals corresponding to a musical program, said method comprising the steps of:

(a) storing a plurality of audio music data and a plurality of lyric data corresponding to a plurality of music programs in an audio storage unit and a lyric storage unit of a recording medium respectively, and storing a plurality of video segments to be commonly shared by the plurality of the musical programs in a video storage unit that is separate from the audio storage unit and the lyric storage unit;

(b) retrieving the audio music data and the lyric data corresponding to a selected one of the musical programs from the recording medium;

(c) retrieving at least a section of the video segments from the recording medium in an order;

(d) converting the audio music data retrieved from the recording medium into an audio output; and (e) combining the lyric data and the sections of the video segments retrieved from the recording medium to obtain a video output;

the audio and video outputs constituting the musical accompaniment signals corresponding to the selected one of the musical programs.

2. The method of claim 1, wherein the sections of the video segments are retrieved from the recording medium in a random order.

3. The method of claim 1, wherein the sections of the video segments are retrieved from the recording medium in a sequential order.

4. The method of claim 1, further comprising the steps of, prior to step (e), processing the section of a preceding one of the video segments retrieved from the recording medium to generate a fade-out effect at the end of the section of the preceding one of the video segments, and processing the section of a succeeding one of the video segments retrieved from the recording medium to generate a fade-in effect at the start of the section of the succeeding one of the video segments.

5. The method of claim 1, wherein the lyric storage unit is separate from the audio storage unit.

6. The method of claim 5, wherein the lyric data include encoded text data and timing information, said method further comprising the step of, prior to step (e), synchronizing the text data with the audio music data retrieved from the recording medium in accordance with the timing information.

7. The method of claim 6, further comprising the steps of, prior to step (e):

decoding the text data and the timing information retrieved from the recording medium to obtain decoded data, and generating bitmap data corresponding to the decoded data and to be synchronized with the audio music data retrieved from the recording medium; and converting the bitmap data into a VGA signal.

8. An apparatus for generating audio-visual musical accompaniment signals corresponding to a musical program, said apparatus comprising:

a recording medium which has an audio storage unit, a lyric storage unit and a video storage unit separate from said audio storage unit and said lyric storage unit, said audio storage unit and said lyric storage unit respectively having a plurality of audio music data and a plurality of lyric data corresponding to a plurality of the musical programs stored therein, said video storage unit having a plurality of video segments to be commonly shared by the plurality of the musical programs stored therein;

processor means connected to said recording medium and operable so as to retrieve the audio music data and the lyric data corresponding to a selected one of the musical programs from said recording medium, and so as to retrieve at least a section of the video segments from said recording medium in an order;

audio converting means connected to said processor means for converting the audio music data from said recording medium into an audio output; and combining means connected to said processor means for combining the lyric data and the sections of the video segments retrieved from said recording medium to obtain a video output;

the audio and video outputs constituting the musical accompaniment signals corresponding to the selected one of the musical programs.

9. The apparatus of claim 8, wherein said processor means retrieves the sections of the video segments from said recording medium in a random order.

10. The apparatus of claim 8, wherein said processor means retrieves the sections of the video segments from said recording medium in a sequential order.

11. The apparatus of claim 8, wherein said processor means processes the section of a preceding one of the video segments retrieved from said recording medium to generate a fade-out effect at the end of the section of the preceding one of the video segments, and processes the section of a succeeding one of the video segments retrieved from said recording medium to generate a fade-in effect at the start of the section of the succeeding one of the video segments.

12. The apparatus of claim 8, wherein said lyric storage unit is separate from said audio storage unit.

13. The apparatus of claim 12, wherein the lyric data include encoded text data and timing information, said processor means synchronizing the text data with the audio music data retrieved from said recording medium in accordance with the timing information.

14. The apparatus of claim 13, wherein:

said processor means decodes the text data and the timing information retrieved from said recording medium to obtain decoded data, and generates bitmap data corresponding to the decoded data and to be synchronized with the audio music data retrieved from said recording medium;

said apparatus further comprising bitmap converting means for converting the bitmap data into a VGA signal.

15. The apparatus of claim 14, wherein the video segments are MPEG standard encoded signals, said combining means comprising an MPEG card that receives the VGA signal from said bitmap converting means and that overlays the text data corresponding to the selected one of the musical programs onto the sections of the video segments retrieved from said recording medium.

16. A method for generating a video output in a musical accompaniment apparatus which generates musical accompaniment signals corresponding to a musical program, the musical accompaniment apparatus including a recording medium with an audio storage unit and a lyric storage unit that respectively have a plurality of audio music data and a plurality of lyric data corresponding to a plurality of the musical programs stored therein, the audio music data and the lyric data corresponding to a selected one of the musical programs being retrievable from the recording medium, said method comprising the steps of:

(a) storing a plurality of video segments to be commonly shared by the plurality of the musical programs in a video storage unit that is separate from the audio storage unit and the lyric storage unit;

(b) retrieving at least a section of the video segments from the video storage unit in an order; and (c) combining the lyric data corresponding to the selected one of the musical programs and the sections of the video segments retrieved from the video storage unit to obtain the video output.

17. The method of claim 16, wherein the sections of the video segments are retrieved from the video storage unit in a random order.

18. The method of claim 16, wherein the sections of the video segments are retrieved from the video storage unit in a sequential order.

19. The method of claim 16, further comprising the steps of, prior to step (c), processing the section of a preceding one of the video segments retrieved from the video storage unit to generate a fade-out effect at the end of the section of the preceding one of the video segments, and processing the section of a succeeding one of the video segments retrieved from the video storage unit to generate a fade-in effect at the start of the section of the succeeding one of the video segments.

20. A device for generating a video output in a musical accompaniment apparatus which generates musical accompaniment signals corresponding to a musical program, the musical accompaniment apparatus including a recording medium with an audio storage unit and a lyric storage unit that respectively have a plurality of audio music data and a plurality of lyric data corresponding to a plurality of the musical programs stored therein, the audio music data and the lyric data corresponding to a selected one of the musical programs being retrievable from the recording medium, said device comprising:

a video storage unit separate from the audio storage unit and the lyric storage unit, said video storage unit having a plurality of video segments to be commonly shared by the plurality of the musical programs stored therein;

processor means connected to said video storage unit and operable so as to retrieve at least a section of the video segments from said video storage unit in an order; and combining means connected to said processor means and adapted to combine the lyric data corresponding to the selected one of the musical programs and the sections of the video segments retrieved from said video storage unit to obtain the video output.

21. The device of claim 20, wherein said processor means retrieves the sections of the video segments from said video storage unit in a random order.

22. The device of claim 20, wherein said processor means retrieves the sections of the video segments from said video storage unit in a sequential order.

23. The device of claim 20, wherein said processor means processes the section of a preceding one of the video segments retrieved from said video storage unit to generate a fade-out effect at the end of the section of the preceding one of the video segments, and processes the section of a succeeding one of the video segments retrieved from said video storage unit to generate a fade-in effect at the start of the section of the succeeding one of the video segments.

* * * * *